United States Patent [19]

Henzelin et al.

[11] Patent Number: 4,513,758

[45] Date of Patent: Apr. 30, 1985

[54] METHOD AND APPARATUS FOR INCREASING THE VOLUME OF TOBACCO

[75] Inventors: Bernard Henzelin, Boncourt; Bernard Courbat-Chavanne, Buix, both of Switzerland

[73] Assignee: Hauni-Werke Körber & Co. KG, Hamburg, Fed. Rep. of Germany

[21] Appl. No.: 491,066

[22] Filed: May 3, 1983

[30] Foreign Application Priority Data

May 11, 1982 [DE] Fed. Rep. of Germany ..... 3217596

[51] Int. Cl.[3] ..... A24B 3/18

[52] U.S. Cl. ..... 131/291; 131/296; 131/300; 131/302; 131/304; 131/306

[58] Field of Search ..... 131/296, 304, 302, 306, 131/303, 291

[56] References Cited

U.S. PATENT DOCUMENTS 4,407,306 10/1983 Hibbitts ..... 131/296

FOREIGN PATENT DOCUMENTS 1290613 9/1972 United Kingdom ..... 131/296

1381203 1/1975 United Kingdom ..... 131/296

*Primary Examiner*—V. Millin

*Attorney, Agent, or Firm*—Peter K. Kontler

[57] ABSTRACT

Tobacco ribs, whose moisture content is at least 38 percent and which are heated to a temperature of at least 60 degrees C., are admitted into a cylindrical chamber containing a centrally located nozzle which is surrounded by a driven impeller having arcuate vanes serving to direct tobacco particles at a uniform rate into a high-speed stream of air or steam which issues from the orifice of the nozzle and leaves the chamber through a tapering outlet to pass through a Laval nozzle and into a dryer. The latter is designed to heat a stream of air to a temperature of approximately 350 degrees C. and to mix such air with the stream which admits the particles of tobacco whereby the particles are heated to a temperature of approximately 80 degrees C. and their moisture content is reduced to or below 20 percent.

19 Claims, 2 Drawing Figures

METHOD AND APPARATUS FOR INCREASING THE VOLUME OF TOBACCO

BACKGROUND OF THE INVENTION

The present invention relates to a method and apparatus for increasing the volume of tobacco, especially for increasing the volume of tobacco ribs and stem.

It is already known to increase the volume of tobacco particles, expecially tobacco ribs, by resort to a variety of wetting, heating and drying techniques. U.S. Pat. No. 3,734,104 discloses a method which involves heating tobacco whose moisture content is very high. The heating step entails evaporation of moisture in the interior and the resultant expansion or puffing of the particles of tobacco. U.S. Pat. No. 4,289,148 proposes to contact tobacco particles with a compressed inert gas so that the gas penetrates into the particles of tobacco. The pressure of gas is thereupon relaxed and the particles of tobacco are heated, e.g., by resort to microwaves. U.S. Pat. No. 4,250,898 proposes to contact the particles of tobacco with carbon dioxide at a relatively low pressure whereby the gas penetrates into the particles. This step is followed by rapid cooling which entails condensation and crystallizing of carbon dioxide in the particles of tobacco. The cooling step is followed by heating which results in expansion of tobacco particles and expulsion of carbon dioxide.

It is further known to subject tobacco ribs to a highly intensive moisturizing action so that they undergo pronounced swelling. The thus swollen particles of tobacco are thereupon contacted by a hot air stream for a short interval of time whereby the air stream solidifies the outermost strata of tobacco particles and stabilizes the shape of expanded material (reference may be had to British Pat. No. 1,290,613). British Pat. No. 1,381,203 discloses the introduction of moist tobacco into a chamber and rapid evacuation of (i.e., reduction of pressure in) the chamber.

A drawback of the above outlined and other prior proposals is that the cost of expanding the volume of tobacco particles is very high, that the increase of volume is relatively small so that it does not warrant the expenditures which are involved in achieving such minor increase of the volume, and/or that the throughput of the apparatus which is used for the practice of conventional methods is low or very low.

OBJECTS AND SUMMARY OF THE INVENTION

An object of the invention is to provide a simple and inexpensive method of expanding the volume of tobacco particles at a rate which is sufficiently high to warrant resort to such method in a tobacco processing plant.

Another object of the invention is to provide a method which ensures a pronounced increase of the volume of tobacco particles with low expenditures of energy.

A further object of the invention is to provide a method which ensures predictable expansion or puffing of tobacco ribs in a small area and at the rate at which the ribs are furnished by a high-speed destalking machine.

An additional object of the invention is to provide a novel and improved method of converting moist tobacco into a mass of expanded tobacco particles.

A further object of the invention is to provide a novel and improved apparatus for the practice of the above outlined method.

Still another object of the invention is to provide an apparatus which occupies little room, whose output is surprisingly high, whose energy requirements are low, and which can be installed in existing plants as a superior substitute for heretofore known tobacco puffing or volume-increasing apparatus.

A further object of the invention is to provide the apparatus with novel and improved means for transporting moist tobacco particles into the range of a tobacco dryer.

An ancillary object of the invention is to provide the apparatus with novel and improved means for ensuring the transfer of tobacco particles into the dryer at a predictable and at least substantially uniform rate.

An additional object of the invention is to provide an apparatus which ensures pronounced expansion of tobacco particles, such as ribs, and permanent increase of the volume of treated material.

One feature of the invention resides in the provision of a method of increasing the volume of tobacco particles. The method comprises the steps of introducing moist tobacco particles (whose moisture content preferably equals or exceeds 38 percent and whose temperature preferably equals or exceeds 60 degrees C.) into a first portion (e.g., a chamber) of a path having a second portion (e.g., the orifice of a nozzle) which is immediately adjacent the first portion and whose cross-sectional area is less than that of the first portion, and rapidly transporting the particles of tobacco from the first portion of the path including aditting from the second into the first portion a high-speed stream of a gaseous fluid (such fluid can contain or consist of air or steam) which entrains the particles of tobacco from the first portion of the path. The first and/or the second portion of the path preferably has an at least substantially circular cross-sectional outline.

The method preferably further comprises the step of at least substantially uniformly distributing the tobacco particles in the first portion circumferentially around the fluid stream flowing from the second into the first portion of the path and simultaneously admitting the distributed tobacco particles, preferably at a constant rate, into the high-speed fluid stream.

The method can also comprise the step of admitting into the first portion of the path a second fluid medium (particularly steam) in a direction having a component coinciding with the direction of flow of the fluid stream from the second into the first portion of the path.

Still further, the method preferably comprises the step of drying the particles of tobacco in a third portion of the path downstream of the first portion, preferably after the particles advance through an elongated accelerating passage whose cross-sectional area diminishes in a direction away from the first portion of the path.

Another feature of the invention resides in the provision of an apparatus for increasing the volume of tobacco. The apparatus comprises a housing which defining a chamber and has an inlet and an outlet both communicating with the chamber, means for admitting moist tobacco particles into the chamber through the inlet, means for evacuating tobacco particles from the chamber by way of the outlet including a source of pressurized fluid (e.g., air or steam) and a nozzle which is installed in the chamber and is connected with the source and has at least one orifice serving to direct a stream of gaseous fluid into the outlet, and means for feeding tobacco particles in the chamber into the stream which issues from the orifice of the nozzle. The cross-sectional outline of the chamber is preferably at least substantially circular and the orifice of the nozzle is preferably disposed centrally of such chamber. The chamber can be defined by an at least substantially cylindrical portion of the housing, and the inlet preferably extends radially of such cylindrical portion.

The feeding means can comprise at least one vane (which preferably constitutes at least a portion of a helix) which is outwardly adjacent to the nozzle in the chamber, and means for orbiting the vane around the nozzle. The vane can form part of an impeller which is rotatable in the chamber and surrounds the nozzle. The outlet is preferably defined by a hollow conical portion of the housing which tapers in a direction away from the orifice of the nozzle.

The apparatus preferably further comprises a tubular accelerating conveyor which defines for the tobacco particles the aforementioned passage downstream of the outlet of the housing. The cross-sectional area of the passage diminishes in a direction away from the outlet. Such passage can direct the particles of tobacco into a drying means; alternatively, the drying means can receive tobacco particles directly from the outlet of the housing. The cross-sectional area of the chamber exceeds the cross-sectional area of the orifice. Still further, the apparatus can comprise means for cleaning the internal surface of the housing in the chamber and the feeding means; such cleaning means preferably includes means for admitting one or more jets of steam into the chamber in such a way that the admitted jets have components of flow coinciding with the direction of fluid flow through the chamber.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
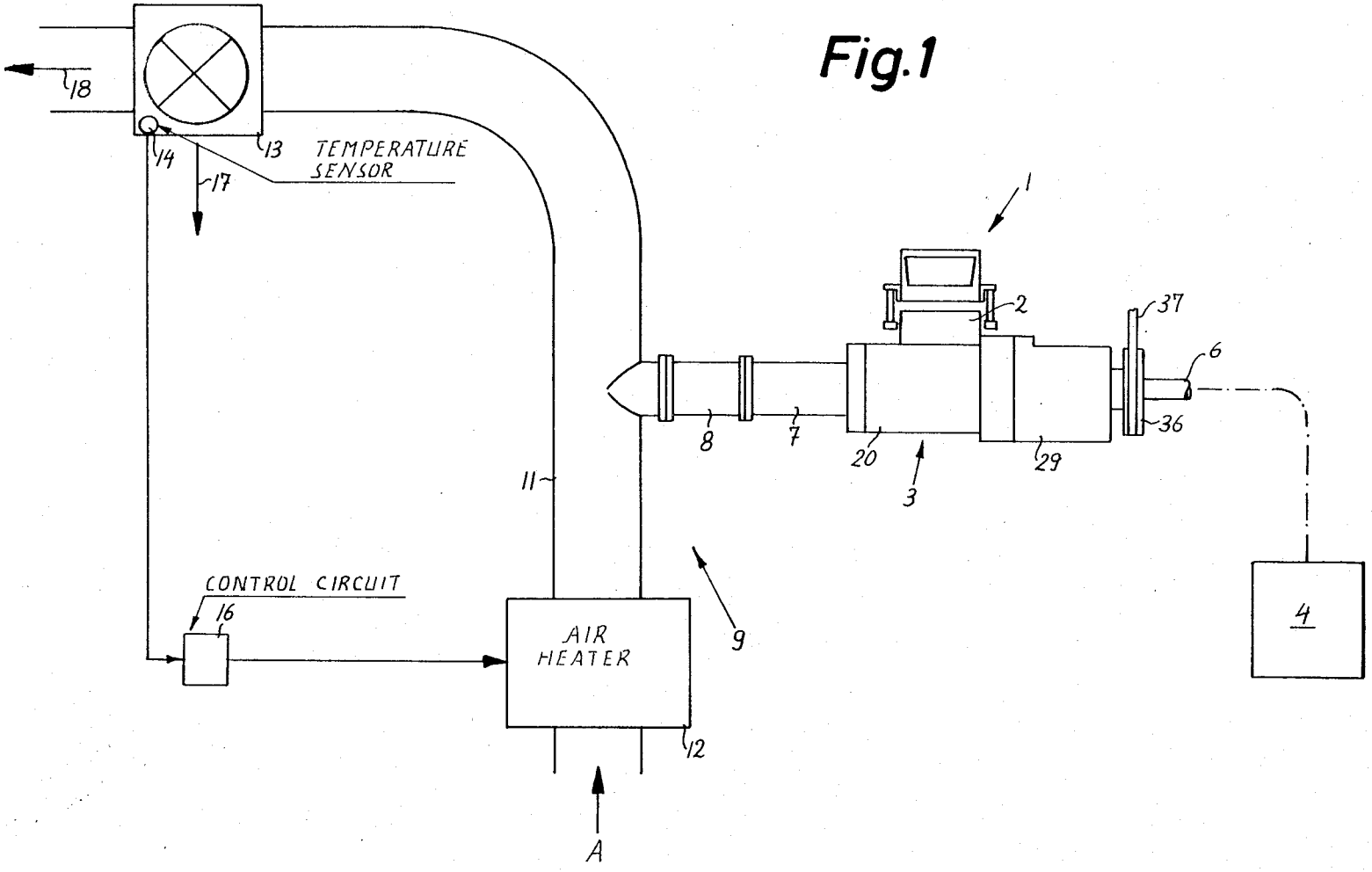
FIG. 1 is a schematic elevational view of an apparatus which embodies the present invention.

The apparatus which is shown in FIG. 1 comprises a vibratory conveyor 1 in the form of a steaming tunnel of the type known as WA (manufactured and sold by the assignee of the present application). The tunnel 1 discharges moist tobacco particles (e.g., tobacco ribs) into a tobacco admitting device which is or includes a hopper 2 serving to admit moist tobacco particles into the chamber 24*a* of a housing 20 which forms part of an injector assembly 3. The details of the injector assembly 3 will be described with reference to FIG. 2. The means for evacuating tobacco particles from the chamber 24*a* through an outlet 26 of the housing 20 comprises a source 4 of compressed gaseous fluid (air or steam), a nozzle 27 which is disposed centrally of the housing 20, and a conduit 6 which connects the source 4 with the intake end of the nozzle 27. The stream of compressed gaseous fluid which issues from the axially extending orifice 27*a* of the nozzle 27 propels moist tobacco particles through a pair of coaxial tubular conveyors 7, 8 and into a device 9 which constitutes a means for drying the moist particles of tobacco. The device 9 is a specially designed dryer which comprises an arcuate pipe 11 extending from an air heater 12 to a cell wheel 13. The intake end of the pipe 11 receives atmospheric air in the direction of arrow A; such air is heated at 12 and flows through the pipe 11 to mix with the stream of gaseous fluid issuing from the pneumatic conveyor 8. The mixture of air and gaseous fluid entrains the particles of tobacco into the cell wheel 13 where the dried particles of tobacco are segregated and leave the dryer 9 in the direction of arrow 17. The gaseous carrier medium is evacuated by suction in the direction of arrow 18. The reference character 14 denotes a temperature sensor which monitors the temperature of tobacco particles leaving the cell wheel 13 and transmits appropriate signals to the control circuit 16 which regulates the action of the heater 12 so that the temperature of tobacco particles leaving the dryer 9 at 17 rapidly reassumes an optimum value if the sensor 14 detects a departure from such optimum value.

Figure 2:
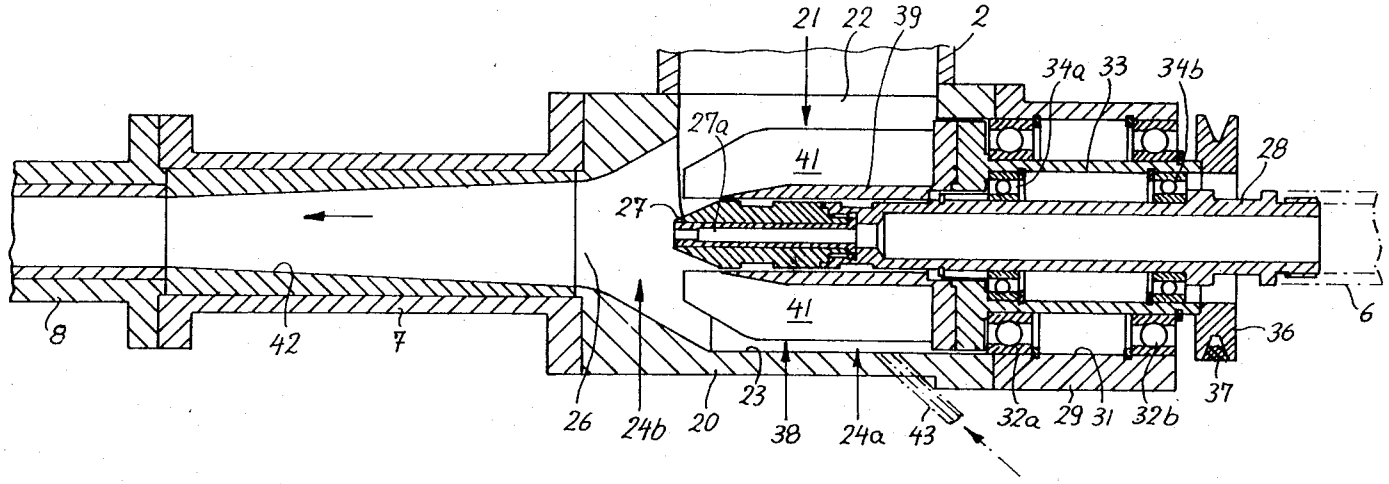
FIG. 2 is an enlarged axial sectional view of a detail in the apparatus of FIG. 1.

The injector assembly 3 is shown in detail in FIG. 2. The housing 20 has a cylindrical portion which surrounds the chamber 24*a* and has a cylindrical internal surface 23. An inlet 22 extends radially of the housing 20, and the outlet 26 is defined by a hollow conical housing portion 24*b* whose internal diameter decreases in a direction away from the orifice 27*a* of the nozzle 27, i.e., in a direction toward the inlet of the tapering passage 42 in the first pneumatic conveyor 7. The hopper 2 of the tobacco admitting means delivers moist tobacco particles to the inlet 22, and such particles are caused to circulate about the nozzle 27 by a device 21 which serves to feed moist tobacco particles into the stream of gaseous fluid issuing from the orifice 27*a* and flowing into the passage 42 of the conveyor 7.

The nozzle 27 is stationary; its body is attached to a fixedly mounted sleeve 28 which is connected to the discharge end of the aforementioned conduit 6.

The housing 20 is attached to a stationary bracket or an analogous support 29 having a bore 31 for antifriction ball bearings 32*a* and 32*b*. The bearings 32*a*, 32*b* surround a sleeve 33 which contains additional antifriction ball bearings 34*a*, 34*b* surrounding the fixed sleeve 28. The sleeve 33 is rigidly connected with a pulley 36 which is driven by an endless V-belt 37 and constitutes therewith a means for rotating the aforementioned feeding device 21 about the nozzle 27 in the interior of the chamber 24*a*. The belt 37 is driven by a further pulley (not shown) which receives torque from an electric motor or another suitable prime mover. The sleeve 33 spacedly surrounds a portion of the fixed sleeve 28 and is rigid with the core 39 of an impeller 38 which forms part of or constitutes the feeding device 21 and is provided with a set of preferably helically configurated vanes or blades 41 surrounding the stationary nozzle 27 in the chamber 24*a*. The front portions of the vanes 41 taper in a direction toward the first pneumatic conveyor 7, preferably at an angle which matches or approximates the taper of the surface forming part of the front portion 24*b* of the housing 20 and surrounding the outlet 26. It will be noted that the vanes 41 extend all the way to or at least into close proximity of the inlet 26; the pitch or lead of such vanes is preferably pronounced.

The first pneumatic conveyor 7 constitutes a so-called Laval nozzle, i.e., the diameter of its passage 42 diminishes in a direction away from the outlet 26 of the housing 20 and toward the inlet of the second pneumatic conveyor 8. The taper of the surface bounding the outlet 26 is more pronounced than the taper of the surface which surrounds the passage 42.

The apparatus preferably further comprises means for cleaning the internal surface 23 of the housing 20 in the chamber 24*a* and the vanes 41 of the impeller 38. To this, end, the housing 20 supports one, two, three or even more suitably distributed nozzles 43 which can admit jets of steam in directions each of which has a component coinciding with the direction of flow of gaseous fluid through the orifice 27*a* and into the passage 42. The nozzles 43 (of which only one is shown in FIG. 2 by phantom lines) constitute an optional but desirable and advantageous feature of the improved apparatus. The jets of steam which issue from the nozzle or nozzles 43 prevent agglomeration of casing and/or tobacco particles along the surface 23 and/or on and between the vanes 41 of the impeller 38 when the apparatus is in use.

The operation is as follows:

Tobacco particles which are admitted into the steaming tunnel 1 are heated to a temperature of at least 60 degrees C. (e.g., to approximately 70 degrees C.) and are discharged into the hopper 2 of the tobacco admitting means while their moisture ($H_2O$) content is not less than 38 percent (e.g., in the range of 41 percent). The hopper 2 admits moist and heated tobacco particles into the inlet 22 whence the particles enter the chamber 24*a* and descend into the range of the orbiting vanes 41 of the impeller 38 which surrounds the stationary nozzle 27. The vanes 41 effect uniform distribution of moist tobacco particles around the nozzle 27 and, at the same time, cause the particles to enter the stream of highly compressed gaseous fluid which issues from the orifice 27*a* and flows into the passage 42 via outlet 26. The configuration of the vanes 41 is such that they effect a movement of tobacco particles in a direction axially of the chamber 24*a* and toward and into the outlet 24*b*. The pressure of gaseous fluid which is supplied by the source 4 and enters the nozzle 27 via conduit 6 and sleeve 28 can equal or approximate 8 bar. The diameter of the orifices 27*a* can be in the range of 5 mm, i.e., a small fraction of the diameter of the chamber 24*a*. The stream of gaseous fluid which issues from the orifice 27*a* entrains successive increments of the mass of moist tobacco particles which are advanced by the vanes 41, and such particles are propelled at an elevated speed through the outlet 26 and the passage 42 of the Laval nozzle 7 into the second pneumatic conveyor 8 on their way into the pipe 11 of the dryer 9. The temperature of hot air which flows in the pipe 11 may equal or approximate 350 degrees C. Such air is mixed with the stream of gaseous fluid which enters the pipe 11 via outlet of the second pneumatic conveyor 8, and the mixture of these gaseous fluids constitutes a carrier medium for the tobacco particles which undergo a pronounced drying and heating action and are segregated from the carrier medium at 13 to leave the dryer 9 in the direction of arrow 17. As a rule, the drying action of the carrier medium in the pipe 11 is so pronounced that the moisture content of tobacco particles leaving the dryer 9 at 13 is reduced to approximately 20 percent $H_2O$. The temperature of dried tobacco particles which leave the dryer 9 is or approximates 80 degrees C. By properly dimensioning the dryer 9, the latter can reduce the moisture content of expanded tobacco particles to or close to 13 percent $H_2O$.

Pronounced acceleration of tobacco particles which enter the pipe 11 of the dryer 9 is attributed to the fact that the diameter or cross-sectional area of the outlet 26 is less than the cross-sectional area of the chamber 24*a*, that the diameter of orifice 27*a* is a small fraction of the diameter of the chamber 24*a* and also that the outlet 26 admits tobacco particles into the tapering passage 42 of the Laval nozzle 7. It has been found that the improved method and apparatus render it possible to considerably increase the volume of tobacco particles in a small area and by resort to relatively simple instrumentalities. Moreover, the apparatus can process large quantities of tobacco per unit of time. The high output is attributable to the provision of the feeding device 21 which ensures uniform distribution of hot and moist tobacco particles around the stationary nozzle 27 in the chamber 24*a* and the admission of uniformly distributed particles into the high-speed stream of gaseous fluid at a predictable and preferably constant rate. The improved method and apparatus ensure highly economical operation because the energy requirements of the apparatus are relatively low, especially if the source 4 contains compressed air.

The nozzle or nozzles 43 prevent the deposition of casing and small particles of tobacco on the internal surface 23 of the housing 20 as well as on the vanes 41 and core 39 of the impeller 38 so that the apparatus can operate for long periods of time without the danger of clogging the chamber 24*a* and/or of reducing the rate at which the impeller 38 feeds tobacco particles into the stream of gaseous fluid issuing from the orifice 27*a* of the nozzle 27. The fluid which is admitted by the nozzle or nozzles 43 is preferably but need not be steam. Heated air can be used with equal or nearly equal advantage.

Another important advantage of the improved method and apparatus is that the moisture content of incoming tobacco particles need not be very high. Satisfactory results were achieved by admitting into the chamber 24*a* tobacco particles whose moisture content is or does not approximately exceed 38 percent.

The subdivision of the chamber 24*a* into an annulus of compartments (by the vanes 41) can be even more pronounced than shown in FIG. 2.

The extent to which the improved method and apparatus can increase the volume of tobacco particles depends on the type of tobacco. Experiments with ribs of Virginia tobacco resulted in volumetric increase or more than 50 percent.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of increasing the volume of tobacco particles, comprising the steps of introducing moist tobacco particles into a first portion of a path having a second portion whose cross-sectional area is less than that of the first portion; rapidly transporting the particles of tobacco from the first portion of said path, including admitting from the second into the first portion of the path a high-speed stream of a gaseous fluid which entrains the particles of tobacco from the first portion of said path; and admitting into the first portion of said path a second fluid medium in a direction having a component coinciding with the direction of flow of said stream from the second portion into the first portion of said path.

2. The method of claim 1, wherein at least one of said portions of said path has an at least substantially circular cross-sectional outline.

3. The method of claim 1, further comprising the step of substantially uniformly distributing the tobacco particles in said first portion circumferentially around the fluid stream flowing from the second into the first portion of said path.

4. The method of claim 1, wherein the fluid of said stream contains air.

5. The method of claim 1, wherein the fluid of said stream contains steam.

6. The method of claim 1, wherein said second medium contains steam.

7. The method of claim 1, further comprising the step of drying the particles of tobacco in a third portion of said path downstream of said first portion.

8. The method of claim 1, wherein the moisture content of tobacco particles which are admitted into the first portion of said path is at least 38 percent.

9. The method of claim 1, wherein the temperature of tobacco particles which enter the first portion of said path is at least 60 degrees C.

10. Apparatus for increasing the moisture content of tobacco, comprising a housing defining a chamber and having an inlet and an outlet both communicating with said chamber, said housing including a substantially cylindrical portion surrounding said chamber and said inlet extending substantially radially of said cylindrical portion; means for admitting moist tobacco particles into said chamber via said inlet; means for evacuating tobacco particles from said chamber via said outlet, including a source of pressurized fluid and a nozzle provided in said chamber, connected to said source and having at least one orifice arranged to direct a stream of gaseous fluid into said outlet; and means for feeding tobacco particles in said chamber into the stream which issues from said orifice, said feeding means comprising at least one vane outwardly adjacent to said nozzle and means for orbiting said vane around said nozzle.

11. The apparatus of claim 9, wherein said chamber has a substantially circular cross-sectional outline and the orifice of said nozzle is disposed substantially centrally of said chamber.

12. The apparatus of claim 10, wherein said feeding means comprises several vanes which divide said chamber into several compartments and each of said vanes constitutes at least a portion of a helix.

13. The apparatus of claim 10, wherein said housing has a hollow conical portion which defines said outlet and tapers in a direction away from said orifice.

14. The apparatus of claim 10, further comprising means for drying the tobacco particles which leave the chamber via said outlet.

15. A method of increasing the volume of tobacco particles, comprising the steps of introducing moist tobacco particles into a first portion of a path having a second portion whose cross-sectional area is less than that of the first portion; rapidly transporting the particles of tobacco from the first portion of said path, including admitting from the second into the first portion of the path a high-speed stream of a gaseous fluid which entrains the particles of tobacco from the first portion of said path; and substantially uniformly distributing the tobacco particles in said first portion circumferentially around the fluid stream flowing from the second into the first portion of said path.

16. Apparatus for increasing the moisture content of tobacco, comprising a housing defining a chamber and having an inlet and an outlet both communicating with said chamber; means for admitting moist tobacco particles into said chamber via said inlet; means for evacuating tobacco particles from said chamber via said outlet, including a source of pressurized fluid and a nozzle provided in said chamber, connected to said source and having at least one orifice arranged to direct a stream of gaseous fluid into said outlet; means for feeding tobacco particles in said chamber into the stream which issues from said orifice; and a tubular conveyor defining a passage for tobacco particles issuing from the chamber via said outlet, the cross-sectional area of said passage diminishing in a direction away from said outlet.

17. The apparatus of claim 16, wherein said housing includes a substantially cylindrical portion surrounding said chamber and said inlet extends substantially radially of said cylindrical portion.

18. Apparatus for increasing the moisture content of tobacco, comprising a housing defining a chamber and having an inlet and an outlet both communicating with said chamber; means for admitting moist tobacco particles into said chamber via said inlet; means for evacuating tobacco particles from said chamber via said outlet, including a source of pressurized fluid and a nozzle provided in said chamber, connected to said source and having at least one orifice arranged to direct a stream of gaseous fluid into said outlet, the cross-sectional area of said chamber exceeding the cross-sectional area of said orifice; and means for feeding tobacco particles in said chamber into the stream which issues from said orifice.

19. Apparatus for increasing the moisture content of tobacco, comprising a housing defining a chamber and having an inlet and an outlet both communicating with said chamber; means for admitting moist tobacco particles into said chamber via said inlet; means for evacuating tobacco particles from said chamber via said outlet, including a source of pressurized fluid and a nozzle provided in said chamber, connected to said source and having at least one orifice arranged to direct a stream of gaseous fluid into said outlet; means for feeding tobacco particles in said chamber into the stream which issues from said orifice; and means for cleaning said feeding means and the internal surface of said housing in said chamber, including means for admitting at least one jet of steam into said chamber.

* * * * *